US006477860B2

(12) United States Patent
Rottmann et al.

(10) Patent No.: US 6,477,860 B2
(45) Date of Patent: Nov. 12, 2002

(54) PROCESS FOR OBTAINING GASEOUS AND LIQUID NITROGEN WITH A VARIABLE PROPORTION OF LIQUID PRODUCT

(75) Inventors: Dietrich Rottmann, München (DE); Christian Kunz, München (DE)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

(21) Appl. No.: 09/810,340

(22) Filed: Mar. 19, 2001

(65) Prior Publication Data

US 2001/0054298 A1 Dec. 27, 2001

(30) Foreign Application Priority Data

Mar. 17, 2000 (DE) ..... 100 13 075

(51) Int. Cl.[7] ..... F25J 3/04
(52) U.S. Cl. ..... 62/652; 62/656
(58) Field of Search ..... 62/652, 656, 643

(56) References Cited

U.S. PATENT DOCUMENTS

| | | | | |
|---|---|---|---|---|
| 4,400,188 A | | 8/1983 | Patel et al. | |
| 4,834,785 A | * | 5/1989 | Ayres | 62/38 |
| 5,275,004 A | * | 1/1994 | Agrawal et al. | 62/24 |
| 5,341,647 A | * | 8/1994 | Koeberle et al. | 62/39 |
| 5,813,251 A | * | 9/1998 | Voit | 62/646 |
| 5,941,098 A | * | 8/1999 | Guillard et al. | 62/656 |
| 5,966,967 A | * | 10/1999 | Agrawal et al. | 62/650 |
| 6,082,137 A | * | 7/2000 | Higginbotham | 62/652 |
| 6,110,980 A | | 8/2000 | Chen | |

FOREIGN PATENT DOCUMENTS

| | | |
|---|---|---|
| DE | 10013073 | 10/2000 |
| FR | 2767317 | 2/1999 |
| GB | 1392294 | 4/1975 |

* cited by examiner

*Primary Examiner*—William Doerrler
*Assistant Examiner*—Malik N. Drake
(74) *Attorney, Agent, or Firm*—Millen, White, Zelano & Branigan, P.C.

(57) ABSTRACT

In a single column distillation system for obtaining gaseous and liquid nitrogen with a variable proportions of liquid product by low-temperature separation from air, a first portion (12, 13) of nitrogen-rich fraction (5, 7, 8) is fed downstream of circulation compressor (9) to the liquefaction chamber of a condenser-evaporator (14) associated with the single column and condensed under a pressure higher than the operating pressure of the single column (4). A liquid oxygen-enriched fraction (228, 231) from the distillation column system is at least partially evaporated in the evaporation chamber of condenser-evaporator (14). A portion (18) of nitrogen-rich liquid (15, 16) from condenser-evaporator (14) is drawn off at least at times as liquid product. A second oxygen-enriched gas (221, 521) is removed from one of columns (546) of the distillation system and/or from the evaporation chamber of condenser-evaporator (14), machine expanded(23), and heated in main heat exchanger (2).

13 Claims, 6 Drawing Sheets

900
800
700
600
500
400
300
200
100
0
7000
6500
6000
5500
5000
4500
4000
3500
3000
2500

PROCESS FOR OBTAINING GASEOUS AND LIQUID NITROGEN WITH A VARIABLE PROPORTION OF LIQUID PRODUCT

CROSS-REFERENCE OF RELATED APPLICATION

This application is related to our concurrently filed application entitled "Process for Obtaining Gaseous Nitrogen," application Ser. No. 09/810,708 based on German Priority Application No. 10013074.7, filed Mar. 17, 2001.

This invention relates to a process for producing gaseous and liquid nitrogen with a variable proportion of liquid product by low-temperature separation of air in a distillation column system, said system being based on a single column rather than a conventional double column.

Single-column processes are known for the production of nitrogen. In contrast to the double-column process, single-column processes have only a high pressure column (the single column) and no conventional low-pressure column, the latter being normally operated with a reflux of a liquid nitrogen containing stream and a feed of oxygen-enriched air, both the reflux and the feed being obtained from the high pressure column under a lower pressure than the high pressure column. Nevertheless, the distillation column system of this invention may have additional columns beyond the single column, for example for obtaining ultra pure nitrogen or oxygen. Such additional columns are distinguished from the single column insofar as a stream having at least as much oxygen as air is not passed into the ultra pure nitrogen column and a liquid nitrogen stream is not passed into the ultra pure oxygen column.

The "distillation column system" comprises distillation columns that are connected to one another, but not the heat exchangers or machines such as compressors or expansion engines. In the simplest case, the distillation column system is formed exclusively by the single column.

"Oxygen-enriched" is defined here as a mixture of producer gases that has a higher oxygen concentration than air up to virtually pure oxygen. For example, oxygen-enriched fractions have an oxygen content of 25 to 90%, preferably 30 to 80%. (All percentages related here and below are molar percents, unless otherwise indicated.)

The process is used for simultaneously obtaining gaseous and liquid product nitrogen, whereby the proportion of liquid (molar ratio between liquid and gaseous product nitrogen) can be variable. At various times, different stationary operating conditions can thus prevail, in which a varying proportion of nitrogen product in liquid form is obtained. In the extreme case, this proportion can be zero. The operation of the process can then be varied between two boundary cases (1), the maximum gas production (MaxGAN case) with minimum proportion of liquid and (2) the maximum liquid production (maxLIN case) with maximum proportion of liquid and minimum proportion of gas (optionally only liquid production of nitrogen). Furthermore, any value of the liquid portion that lies between the two boundary values for minimum and maximum liquid proportions can also be adjusted.

Known from U.S. Pat. No. 4,400,188 is a process with a nitrogen circuit which comprises cooling compressed feed air in a main heat exchanger and introducing the resultant cooled feed air to said single column operating under pressure; withdrawing a nitrogen-rich fraction from the distillation column system and compressing said nitrogen-rich fraction, at least in a part in a circulation compressor;

passing a part of said nitrogen-rich fraction downstream from said circulation compressor to a liquefaction chamber of a condenser-evaporator and condensing said first part of said nitrogen-rich fraction under a pressure higher than the operating pressure of said single column so as to form a nitrogen-rich liquid; passing a liquid, oxygen-enriched fraction from the distillation column system to an evaporation chamber of the condenser-evaporator so as to at least partially evaporate said liquid, oxygen-enriched fraction; passing a first oxygen-enriched gas (234, 533) formed in the evaporation chamber, as ascending vapor into the single column; and withdrawing a second portion of nitrogen-rich fraction at least at times as gaseous nitrogen product, according to the introductory clause of claim 1 is known from U.S. Pat. No. 4,400,188.

A condenser-evaporator, which represents the bottom heating of the single column, is heated with nitrogen, which was brought to a level above column pressure in a circulation compressor. Process cold is produced by an ordinary residual-gas turbine, which is operated with gas from another condenser-evaporator, a top condenser. Such processes with a nitrogen circuit are more advantageous in terms of energy than single-column processes without bottom heating. Because of the circulation, it is believed that a liquid nitrogen product in a variable amount can also be produced in this process, even if this is not described in the publication itself. In such a process, however, difficulties would be encountered if it were desired to vary the proportion of liquid product. If, for example, the liquid proportion is increased, the oxygen concentration and thus the evaporation temperature at the bottom would be decreased with a uniform amount of air. The pressure in the nitrogen circuit must be correspondingly lower, and the circulation compressor thus must be readjusted accordingly. Without changing the circulation pressure, the pressure in the column would increase; in this case, the exhaust pressure of the air compressor must be adjusted accordingly.

SUMMARY OF THE INVENTION

The object of the invention is to provide a process of the above-mentioned type and corresponding apparatus, in which in addition to the gaseous nitrogen product, a variable amount of liquid product can be obtained at relatively low cost.

Upon further study, other objects and advantages of the invention will become apparent.

These objects are achieved by withdrawing a portion of the nitrogen-rich liquid from the condenser-evaporator at least at times as a liquid product, operating the evaporation chamber of the condenser-evaporator under a pressure higher than the operating pressure of the single column, and removing a second oxygen-enriched gas from one of the columns of the distillation column system and/or from the evaporation chamber of the condenser-evaporator, machine expanding same and heating the resultant cold gas in the main heat exchanger.

The liquid product can be removed directly in the liquefaction chamber of the condenser-evaporator. It is preferably first depressurized, however, and in this case the flash gas that is produced is separated. The phase separation can be performed, for example, in the single column or in a separate separator.

The operating pressures of the condenser-evaporator and the single column are decoupled by the increased pressure on the evaporation side of the condenser-evaporator. In the case of increasing liquid production, the pressure on the liquefaction side of the condenser-evaporator (nitrogen circuit) does not need to be altered. The pressure on the evaporation side can rather be adjusted—regardless of the operating pressure of the single column—with uniform evaporation temperature on the lower oxygen concentration without any compression machines having to be readjusted.

The second oxygen-enriched gas, which is provided for active pressure reduction, is preferably produced from the vapor formed in the condenser-evaporator like the first oxygen-enriched gas. The two oxygen-enriched gases have, for example, the same composition. The inlet pressure of the active pressure reduction is not—as is otherwise common in residual-gas turbines—bonded to the single column- or top condenser pressure, but rather preferably to the evaporation pressure in the condenser-evaporator. The inlet pressure of the turbines within the framework of an increase of the proportion of liquid product can therefore increase analogously to the evaporation pressure. By the correspondingly increased enthalpy difference in the machine expansion of the second oxygen-enriched gas, additional cold is produced, which is necessary for the increased product liquefaction. The increase of the residual-gas amount also increases the production of cold output.

In general, a process for obtaining gaseous and liquid nitrogen is achieved in which the proportion of liquid product can be varied in a very simple way. The proportion of liquid product can be, for example, 0 to 20%, preferably 0 to 16% of the entire nitrogen product, in a total product amount of nitrogen of, for example, 75 to 0%, preferably 75 to 25% of the amount of air. The operating pressure at the bottom of the single column is, for example, 3 to 8 bar, preferably 3 to 5 bar. The pressure difference between the evaporation side of the condenser-evaporator and lower section of the column is, for example, 0 to 5 bar, preferably 0 to 3 bar.

Since the second oxygen-enriched gas ultimately must be derived from the single column, a corresponding pressure-increasing step, which is performed in the invention preferably in the liquid state, for example with a liquid pump, is required. To this end, an oxygen-enriched liquid is removed from the single column and brought to an increased pressure in the liquid state, whereby the second oxygen-enriched gas is produced from the resulting oxygen-enriched liquid that is under increased pressure.

In particular for the case that the distillation column system has only a single column, the oxygen-enriched liquid downstream from the pressure increase forms the oxygen-enriched liquid fraction that is introduced into the evaporation chamber of the condenser-evaporator. The oxygen-enriched liquid is, for example, the bottom liquid of the single column, under which is the evaporation chamber of the condenser-evaporator and it is pumped to at least the increased pressure. The first and the second oxygen-enriched gases, thus the rising vapor for the single column and the fraction that does the work via depressurization, are produced here directly by evaporation of the liquid fraction from the single column.

If it is desired to produce an oxygen product whose purity is higher than that of the bottom fraction of the single column, the procedure is as follows within the scope of the invention. In addition to the single column, the distillation column system has a pure oxygen column. The oxygen-enriched liquid from the single column is passed to the pure oxygen column downstream from the pressure increase. From the lower area of the pure oxygen column, an oxygen-rich fraction is drawn off as a gaseous and/or liquid product and/or intermediate product. The liquid, oxygen-enriched fraction, which is fed to the evaporation chamber of the condenser-evaporator, also is supplied from the lower area of the pure oxygen column. The vapor that is produced in the condenser-evaporator is introduced into the lower area of the pure oxygen column and is used there as ascending vapor. The overhead gas of the pure oxygen column is used in this case in a first part as a working gas of the machine expansion("second oxygen-enriched gas") and in a second part—after corresponding pressure reduction—as ascending vapor in the single column ("first oxygen-enriched gas"). Because of the higher oxygen concentration on the evaporation side of the condenser-evaporator, a higher circulation pressure prevails in this variant than in embodiments in which the evaporation side of the condenser-evaporator is exposed to bottom liquid of the single column.

Stated in simplified terms, an additional mass transfer section—named pure oxygen column—is placed above the condenser-evaporator, and this section is operated under the increased pressure. In this mass transfer exchange section, the liquid that is brought to the increased pressure from the single column is further concentrated in oxygen and more-volatile components are removed from it. Liquid and/or steam from the bottom of the pure oxygen column can be drawn off directly as oxygen product and/or fed to another operating step.

In this embodiment of the invention, the condenser-evaporator is preferably arranged directly at the bottom of the pure oxygen column, but it can also be housed in a separate container. The pure oxygen column is preferably designed as a pure stripping column and contains, for example, 30 to 50, preferably 35 to 45, theoretical plates.

The oxygen-rich fraction can be further purified in the distillation column system by being fed to an additional column for removal of low-volatility contaminants, from whose upper part a pure oxygen product is drawn off. The oxygen-rich fraction is preferably drawn off from the bottom part of the pure oxygen column or from the evaporation chamber of the condenser-evaporator. In the additional column, the ascending vapor is liberated of low-volatility components that are removed accordingly in the pure oxygen product (for example less than 100 ppm, preferably less than 10 ppm of contaminants with a higher boiling point than oxygen; residual contents of up to about 1 ppb can be achieved). Residual liquid from the additional column can be fed back to the pure oxygen column or the condenser-evaporator. The additional column is preferably designed as a pure concentrating (enrichment)column and contains, for example, 10 up to 40 preferably 10 up to 30 theoretical plates.

Reflux liquid for the additional column is preferably produced in a top condenser in which a second oxygen-enriched liquid fraction is at least partially evaporated from the lower part of the single column. The second oxygen-enriched liquid fraction can be drawn off from the single column, for example, together with the oxygen-enriched liquid that is released to the pure oxygen column and brought to an increased pressure.

In all previously mentioned embodiments of the invention, the entire reflux liquid for the single column and optionally the pure oxygen column is preferably produced in the condenser-evaporator. In general, only a single condenser-evaporator is therefore necessary; in the case of an additional column, two condenser-evaporators are necessary.

Air compressors and circulation compressors can be formed by a single machine, namely by a combi-machine, in which several pinion gears are arranged on a shaft, some of which form part of the air compressor and one or more form part of the circulation compressor.

The circulation compressor can be formed at least partially by a compressor that is coupled to the residual-gas turbine, whereby at least a portion of the mechanical energy that is produced in the machine expansion of the second oxygen-enriched gas is used for compression of the first portion and/or the second portion of the nitrogen-rich fraction.

If a nitrogen product of especially high purity is to be produced, it is advantageous if the distillation column system has a pure nitrogen column, whereby a nitrogen fraction from the upper area of the single column in the liquid state is released to the pure nitrogen column, and a pure nitrogen product is drawn off from the lower area of the pure nitrogen column. The pure nitrogen column is used for removing highly volatile contaminants from nitrogen, especially helium, neon and hydrogen. The bottom product of the pure nitrogen column is virtually free of helium, neon and hydrogen (for example less than 10 ppb, preferably less than 5 ppb of highly volatile components that are lighter than nitrogen) and can be drawn off in gas or liquid form. The pure nitrogen column is preferably operated as a pure stripping column and contains, for example, 10 to 20, preferably 10 to 15, theoretical plates.

The nitrogen circuit (first portion of the nitrogen-rich fraction from the distillation column system) can be operated either with very pure gas from the lower part of the pure nitrogen column or with top gas of the single column. It can also be drawn off as a possibly gaseous pressure product (second part of the nitrogen-rich fraction of the distillation system) helium- and neon-free from the pure nitrogen column and/or somewhat less pure from the top of the single column.

The pure nitrogen column preferably has a bottom evaporator, whereby the nitrogen fraction is removed in gaseous form from the single column and is liquefied before it is passed to the pure nitrogen column in the bottom evaporator. By this procedure, no further heating agent for the operation of the pure nitrogen column is necessary. The operating pressure of the pure nitrogen column is somewhat lower (for example by 0.5 to 1.0 bar) than the pressure at the top of the single column. The fraction that is liquefied in the bottom evaporator is depressurized in its operating pressure before being passed to the pure nitrogen column.

In addition, the invention relates to an apparatus for obtaining gaseous nitrogen by low-temperature separation from air with a distillation column system comprising a single column (4), an air compressor, a main-heat exchanger, passage means for feed air to the single column (4) from the air compressor through the main heat exchanger (2);a circulation compressor (9, 1063) for compression of the first portion of a nitrogen-rich fraction (5, 7, 8) from the distillation column system; a circulation line (12, 13), from the outlet of circulation compressor (1063, 9) to a liquefaction chamber of a condenser-evaporator (14); means for feeding a liquid, oxygen-enriched fraction from the distillation column system to the evaporation chamber of condenser-evaporator (14); means for the production of a first oxygen-enriched gas (234, 533) from vapor (232) formed in the evaporation chamber of the condenser-evaporator (14) and for introduction into the single column (4), with a gas production line for drawing off a second portion (19, 20, 1064) of nitrogen-rich fraction (5, 7, 8) as a gaseous nitrogen product, said apparatus further comprising a liquid product line (16, 16), connected to the liquefaction chamber of the condenser-evaporator (14), said condenser-evaporator (14) being inside a container separated from single column (4), and a machine (23) for expanding a second oxygen-enriched gas (221, 521) from one of columns (546) of the distillation system and/or from the evaporation chamber of condenser-evaporator (14).

BRIEF DESCRIPTION OF THE DRAWING

The invention and further details of the invention are explained in more detail below based on the embodiments that are diagrammatically depicted in the drawings wherein.

Figure 1:
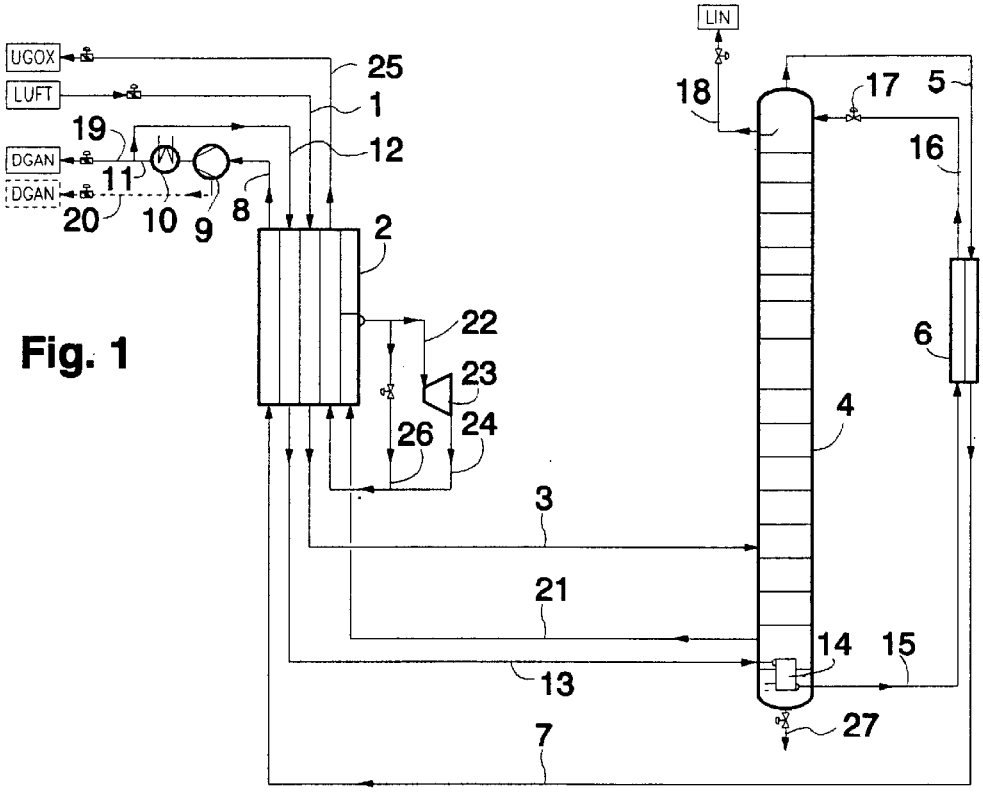
FIG. 1 shows a process and a device with a condenser-evaporator arranged inside the single column.

In the drawings "LUFT" is air, "UGOX" is impure gaseous oxygen, "DGAN" is compressed gaseous nitrogen, "GOX" is gaseous oxygen, "UPLOX" is ultra pure liquid oxygen, "UPLIN" is ultra pure compressed liquid nitrogen, and "LIN" is liquid nitrogen.

In the process of FIG. 1, compressed and purified feed air, which is under a pressure of about 3.5 bar, is brought in via a line 1. (Air compressors and air purification—for example using a molecular sieve—are not shown in the drawing). The air is cooled in a main heat exchanger 2 to approximately dewpoint and fed via line 3 to a single column 4 at an intermediate point. The intermediate point is, for example, 5 to 20 theoretical or actual plates above the bottom of column 4. The operating pressure at the bottom of the single column is 3.0 bar in the example.

Overhead nitrogen 5 (the "nitrogen-rich fraction") from the single column 4 also contains 1 ppm to 1 ppb oxygen and is heated in a sub-cooler 6 and (line 7) further in a main heat exchanger 2 to approximately ambient temperature. Warm overhead nitrogen 8 is fed to a circulation compressor 9, which has, for example, two to three stages. Behind each stage of the circulation compressor is secondary or intermediate cooling for removal of compression heat, of which, however, in the diagrammatic drawing, only secondary cooling 10 behind the final stage is shown. A first portion 12 of overhead nitrogen 11 that is compressed to a pressure of 9.5 bar is fed back to main heat exchanger 2, cooled there to several Kelvin above the column temperature and fed via line 13 to the liquefaction chamber of a condenser-evaporator 14. There, it is completely or almost completely liquefied under approximately the exhaust pressure of circulation compressor 9. Nitrogen-rich liquid 15 that is formed in this case is sub-cooled in sub-cooler 6 and released via line 16 and throttle valve 17 to the top of the single column. A portion 18 of nitrogen-rich liquid 16 can be drawn off as liquid nitrogen product LIN. In the drawing, the liquid nitrogen is drawn off from the single column, whose top is used here as a flash gas separator between throttle valve 17 and liquid product drawing 18.

A second portion 19 of overhead nitrogen 11 that is compressed in circulation compressor 9 is drained off as a gaseous nitrogen product under pressure (DGAN). As an alternative or in addition, a portion 20 of the compressed nitrogen can be brought out from an intermediate stage of the circulation compressor and obtained at a pressure between the operating pressure of single column 4 and the final pressure of circulation compressor 9 as a gaseous compressed nitrogen product (DGAN'). In both cases, circulation compressor 9 is used simultaneously as a product compressor.

Condenser-evaporator 14 is placed directly in the bottom of the single column in the example of FIG. 1. On its evaporation side, the oxygen-enriched bottom liquid of single column 4 evaporates under its operating pressure while forming vapor having an oxygen content of about 80%. While a first portion of the vapor, produced in condenser-evaporator 14, in single column 4 rises ("first oxygen-enriched gas"), a second portion 21 ("second oxygen-enriched gas") is fed to the cold end of main heat exchanger 2. After being heated to an intermediate temperature, this fraction flows via line 22 to a residual-gas turbine 23 and is machine expanded there by about 3 bar to about 1.5 bar. Machine expanded oxygen-enriched gas 24 is completely heated in main heat exchanger 2 and disposed of via line 25 as impure oxygen product UGOX. It can be used as regeneration gas in the air purification, not shown, and/or as gaseous by-product and/or disposed of in the atmosphere. Delaying of gas to turbine 23 can be adjusted via a bypass 26. A small amount of liquid 27 is drained off continuously or intermittently as rinsing liquid from the evaporation chamber of condenser-evaporator 14.

The process according to FIG. 1 is distinguished from the prior art according to U.S. Pat. No. 4,400,188 by the type of production of cold output. This is achieved here by machine expansion of an oxygen-enriched gas 21 from the evaporation chamber of condenser-evaporator 14. This measure ensures a simplification of the apparatus, since only a single condenser-evaporator is necessary to the operation of single column 4, but the desired simple variation of the liquid product portion thus still cannot be performed by itself, as is the case in the embodiments of FIGS. 2 to 10.

Figure 2:
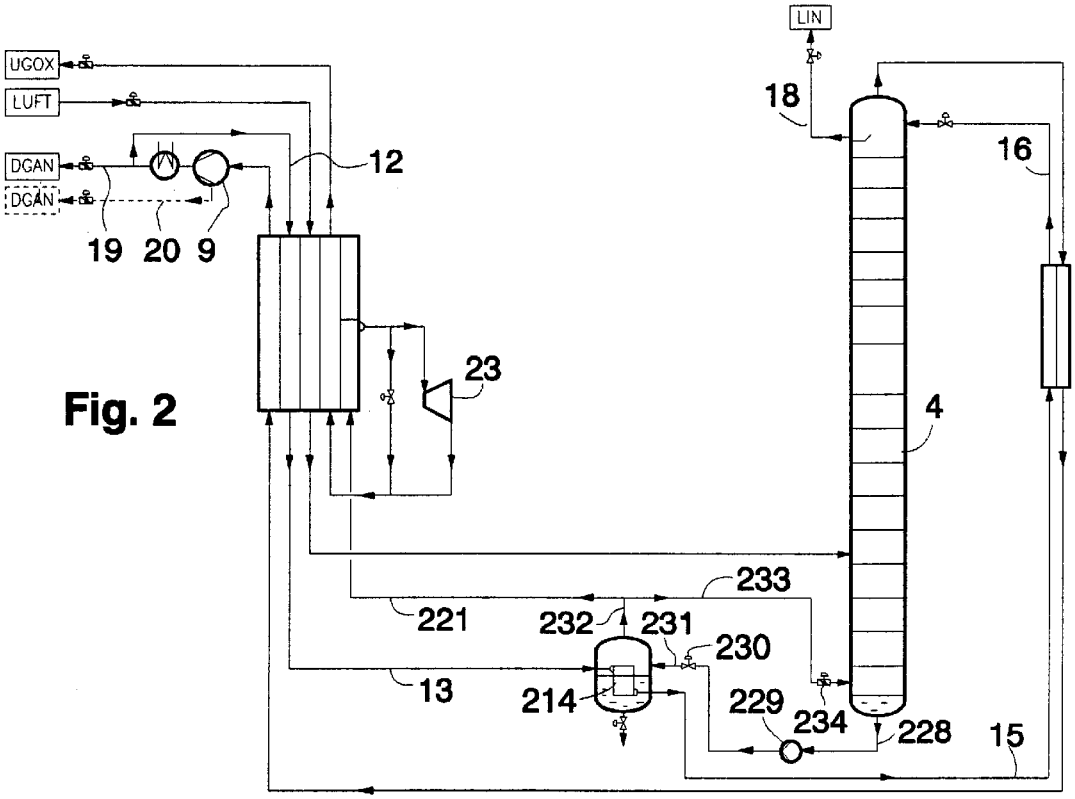
FIG. 2 shows a first embodiment of the invention with a single column and a single condenser-evaporator.

In the process and the unit of FIG. 2, condenser-evaporator 214 is placed in a separate container outside of single column 4. In this case, this represents not only a hardware detail but rather makes it possible in processing to decouple the pressure in the evaporation chamber of condenser-evaporator 214 from the operating pressure of single column 4. The bottom liquid (the "liquid oxygen-enriched fraction") 228 is brought here to a pressure of 4 to 8 bar using a pump 229 and introduced under this increased pressure or optionally after slight choking action 230 via line 231 into the evaporation chamber of condenser-evaporator 214. Vapor 232, which is drawn off from condenser-evaporator 214 under this pressure, flows back into a first portion ("first oxygen-enriched gas") 233 under choking action 234 to single column 4. A second portion ("second oxygen-enriched gas") 221 is fed to a residual-gas turbine 23 in FIG. 2 analogously to stream 21 of FIG. 1, but the exhaust pressure of said turbine is somewhat higher than in the process of FIG. 1.

To ensure the evaporation under the increased pressure, a correspondingly increased pressure of about 9 bar must also prevail on the liquefaction side of condenser-evaporator 214, i.e., circulation compressor 9 must have a correspondingly higher final pressure.

The advantage of decoupling the condenser-evaporator from the operating pressure of the column does not just result in only a somewhat larger cold production of turbine 23, which is a result of the higher inlet pressure. Rather, by this measure, the liquid production (here, only liquid nitrogen 18), can be varied by relatively simple means in a range of about 0 to 4.3% of the amount of volume of charging air. The switching between the operating cases works as follows: To achieve, for example, maximum liquid production, first the release of gaseous nitrogen (via line 19 and/or line 20) is reduced, whereby the circulation compressor continues unchanged with constant throughput and constant final pressure, just like the air compressor that is not shown in the drawings. More nitrogen is thus run to condenser-evaporator 214, and thus more liquid is released to single column 4 via line 15/16. The oxygen concentration at the bottom drops by the increased reflux ratio in the column. As a result of this, the evaporation pressure of the oxygen-enriched fraction in the evaporation chamber of the condenser-evaporator is increased by, for example, 3 bar in the MaxGAN case to up to, for example, 6 bar in the MaxLIN case. This in turn results in an increase of inlet pressure and throughput in turbine 23. As a result, a correspondingly increased production of cold output for the desired additional product liquefaction is available. Vapor 233 that flows back into column 4 is thus throttled (234) so that the operating pressure of single column 4 remains constant. The liquid production can be increased to the extent that absolutely no more gaseous compressed nitrogen product is disposed of via lines 19 or 20, but rather the entire nitrogen that is produced is obtained via line 18 as a liquid product.

To achieve the opposite, the maximum compressed gas production with a liquid production of, for example, 0% of the amount of volume of feed air, the procedure is performed exactly in reverse. Condenser-evaporator 214 is then run on the evaporation side at a pressure that is about 0.2 bar higher than the pressure at the bottom of the single column; the two pressures can also be equal in the extreme case. Nevertheless, in this procedure, an energy savings of about 30% compared to a standard nitrogen generator follows. In the invention, the (not shown) air compressor and circulation compressor 9 are combined preferably in a combi-machine and are provided with a common drive. The characteristic curve of the apparatus can be run back and forth fully automatically between the above-mentioned extreme operating cases and any intervening case without the compression machines (air compressor and circulation compressor) having to be readjusted. Only the residual-gas turbine and the amount of gaseous product nitrogen have to be adapted.

FIGS. 3 to 8 show how the process according to the invention can be expanded to obtaining pure oxygen, ultra pure oxygen and/or ultra pure nitrogen.

Figure 3:
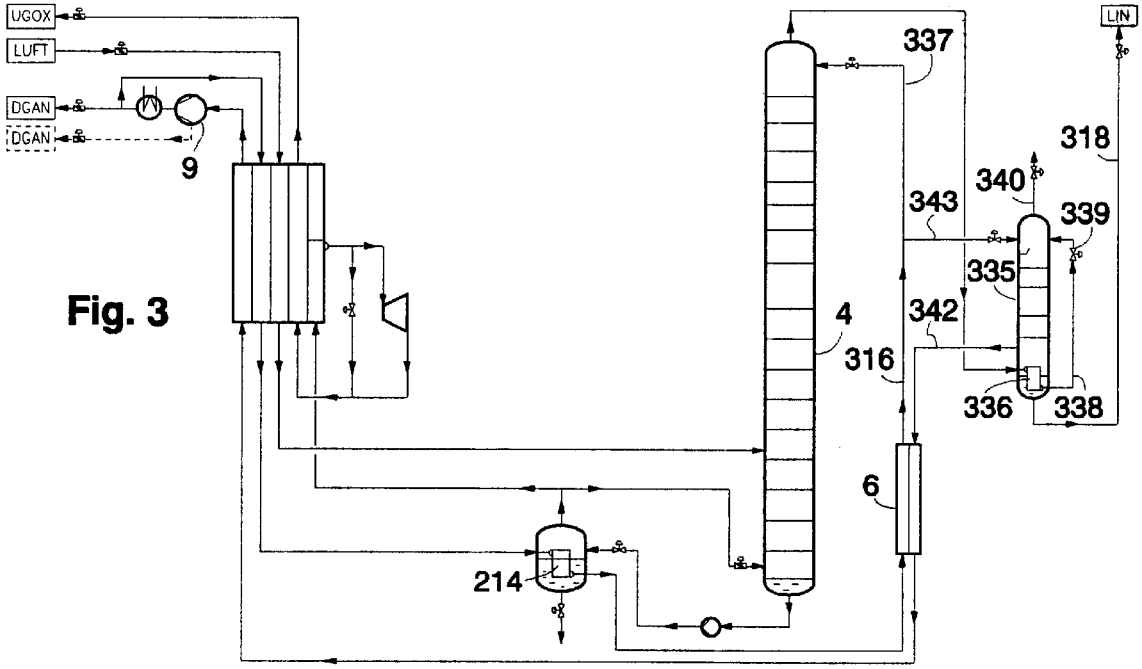
FIG. 3 shows an embodiment of the invention with obtaining of highly pure nitrogen.

FIG. 3 corresponds to FIG. 2 to a large extent. The process and the device of FIG. 3, however, show in addition a pure nitrogen column 335 with bottom evaporator 336. Top nitrogen 337 from single column 4 (operating pressure here: about 3 bar at the top) is at least partially condensed in bottom evaporator 336 and released via line 338 after throttling 339 to about 2.5 bar on the top of pure nitrogen column 335. More-volatile components, especially helium, neon and hydrogen, which are drawn off with a purge gas 340, are stripped from the liquid that flows out into column 335. Ultra pure nitrogen, which contains less than about 0.1 ppm of contaminants, accumulates at the bottom. In a first part, it forms liquid nitrogen product 318. The residue is drawn off via line 342, the "nitrogen-rich fraction" forms and is fed to circulation compressor 9. Nitrogen-rich liquid 316 that is produced in condenser-evaporator 214 is partially released via line 343 to the top of pure nitrogen column 335. This amount of liquid nitrogen at the top of pure nitrogen column 335 corresponds exactly to LIN-product amount 318. Amount 388 is evaporated against itself in bottom evaporator 336.

Figure 4:
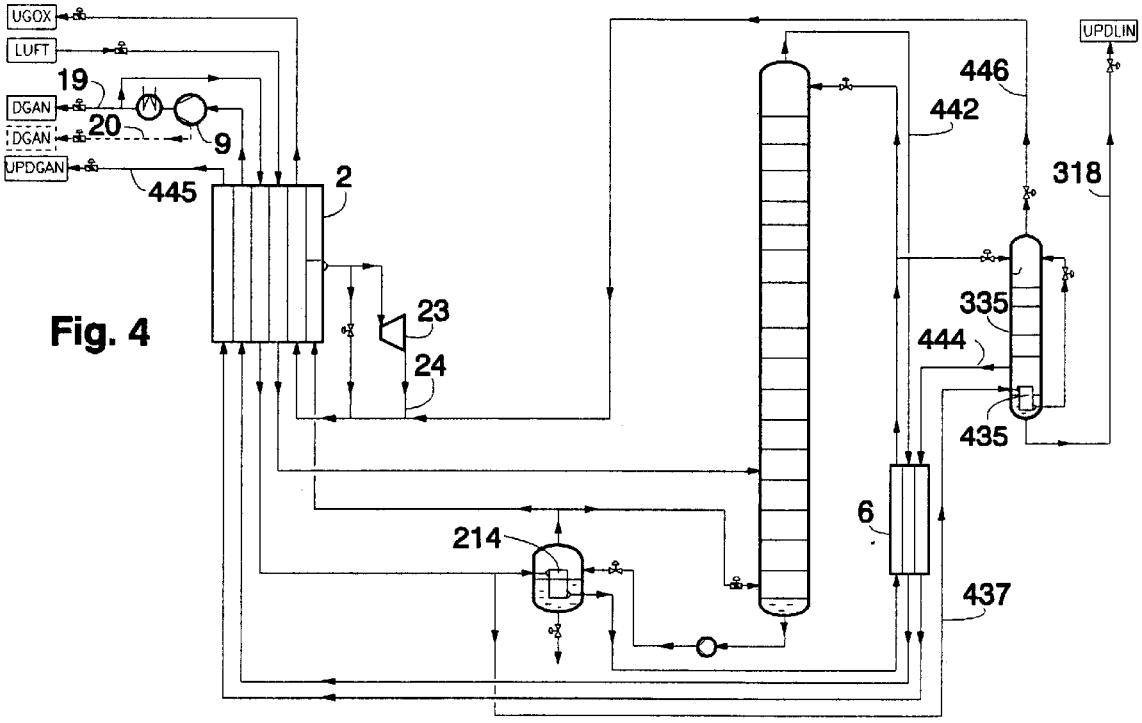
FIG. 4 shows a variant with two nitrogen products of different purity.

In FIG. 4, unlike FIG. 3, circulation compressor 9 is not directly fed with gas from pure nitrogen column 335 but rather from top gas 442 of single column 4, which forms the "nitrogen-rich fraction" here. In this case, compressed nitrogen product 19, 20 thus contains highly volatile contaminants such as helium and neon. The overhead nitrogen, which is used as a feedstock for pure nitrogen column 335 and as a heating agent for its bottom evaporator 435, is also run in the circuit and diverted upstream from condenser-evaporator 214 via line 437. Pure nitrogen column 335 can therefore be operated under a higher pressure than the single column, for example at 8 bar. In addition to compressed nitrogen product(s) 19, 20 and highly pure liquid nitrogen product 318, another gaseous compressed nitrogen product 444, 445 (UPDGAN) with ultra high purity can be obtained at the bottom of pure nitrogen column 335. A residual fraction 446 is drawn off from the top of pure nitrogen column 335 and heated, for example, together with the waste gas of turbine 23 in main heat exchanger 2.

Figure 5:
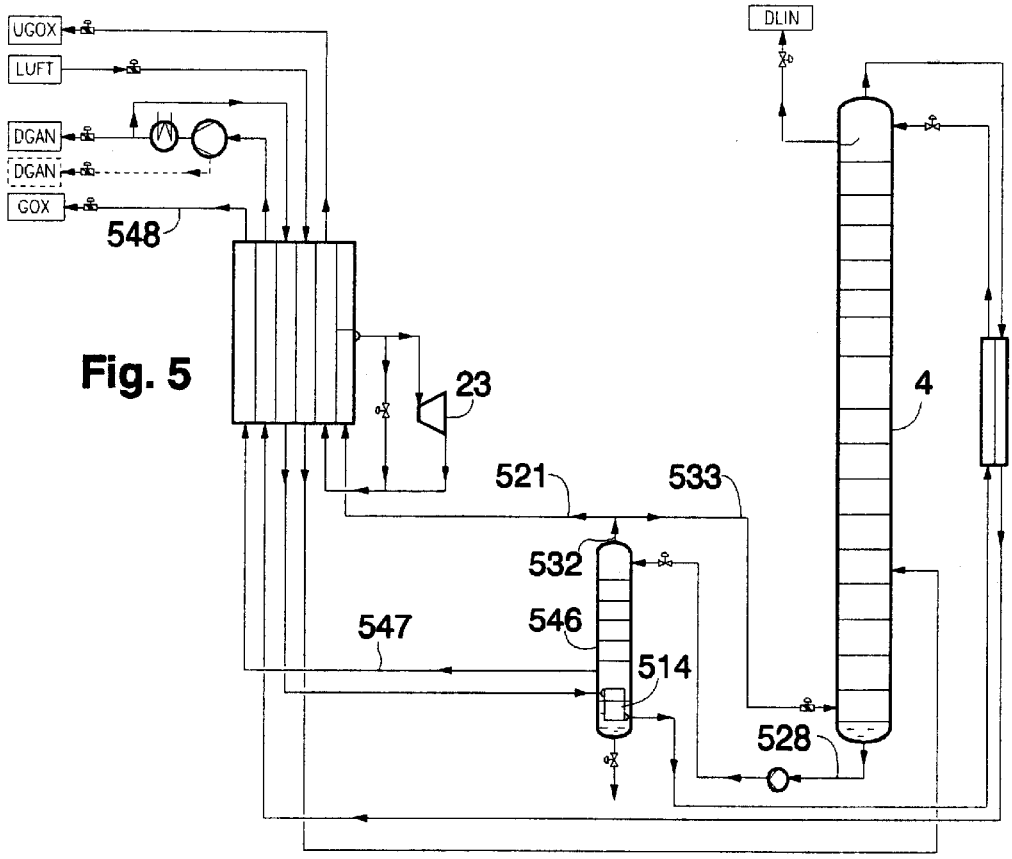
FIG. 5 shows a process in which pure oxygen is also obtained as a product.

The process and the unit of FIG. 5 are used to obtain additional oxygen of a purity of 99.5 to 99.9999%, preferably 99.5 to 99.9%, which is argon-free (1 ppm of argon or less). For this purpose, a mass transfer section is arranged above condenser-evaporator 514 that is known from FIGS. 2 to 4 around the periphery of 30 to 60 theoretical or actual plates, which forms a pure oxygen column 546. The bottom liquid of single column 4 is not run directly to condenser-evaporator 514, but rather to the top of pure oxygen column 546. When this column is flushed, additional oxygen accumulates. The "liquid oxygen-enriched fraction" is formed here by the bottom liquid of pure oxygen column 546.

Overhead gas 532 from pure oxygen column 546 of FIG. 5 forms in a first part "first oxygen-enriched gas" 533 and in a second part "second oxygen-enriched gas" 521. The two fractions are fed to the single column or machine expansion 23 in the case of the above-described embodiments. From the evaporation chamber of condenser-evaporator 514, which is housed in the bottom of pure oxygen column in the example, a gaseous oxygen product GOX, which is purer than the first oxygen-enriched gas fraction 532, is drawn off via lines 547 and 548.

Figure 6:
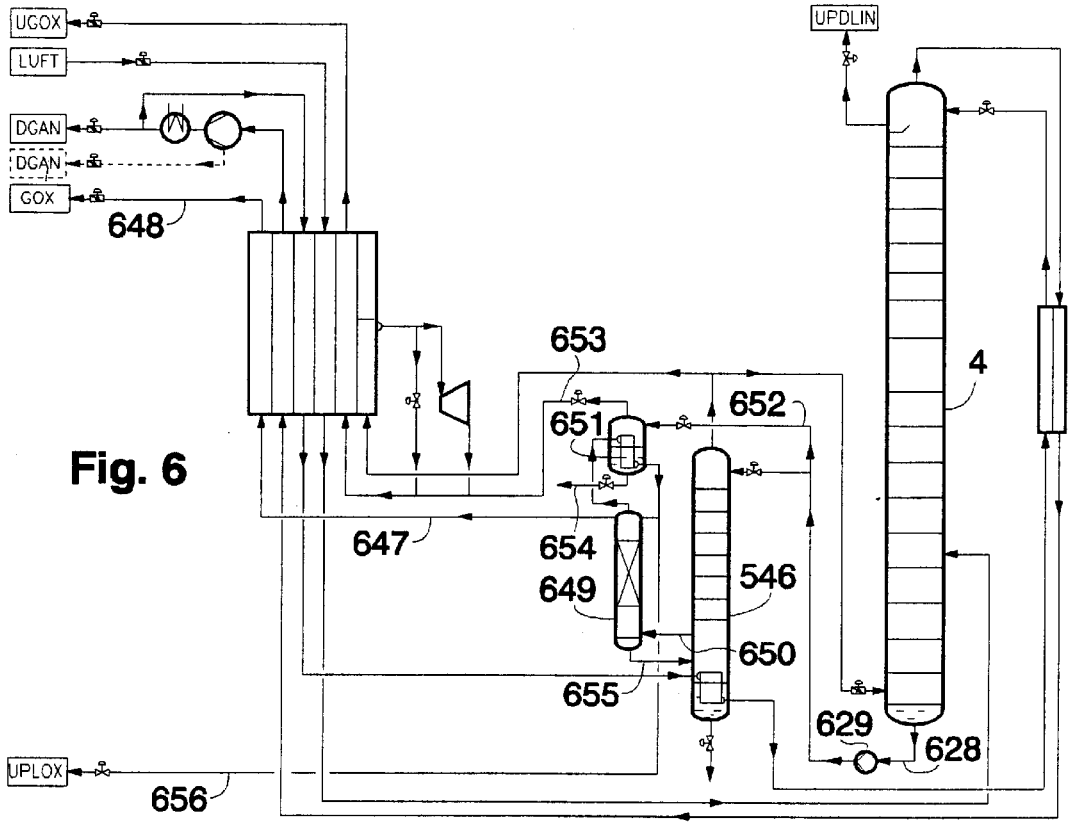
FIG. 6 shows another embodiment with production of highly pure oxygen.

In FIG. 6, moreover, an additional column 649 is provided, which is used for separating low-volatility components such as hydrocarbons, krypton and/or xenon from gaseous bottom product 650 of pure oxygen column 546. It is operated under the same pressure as pure oxygen column 546 and has a top condenser 651, which is cooled with a portion 652 of bottom liquid 628 from the single column 4 that is brought up to pressure in pump 629. Vapor 653 that is produced in this case is admixed with the waste gas of turbine 23. A purging can also be performed here via line 654. Bottom liquid 655 of additional column 649 is returned to the bottom of pure oxygen column 546. At the top of additional column 649, highly pure oxygen with a total content of 1 ppm accumulates in residual contaminants. It is disposed of in a first portion 647, 648 as a highly pure product that is gaseous and in a second portion 656 as a ultra pure product that is liquid.

Figure 7:
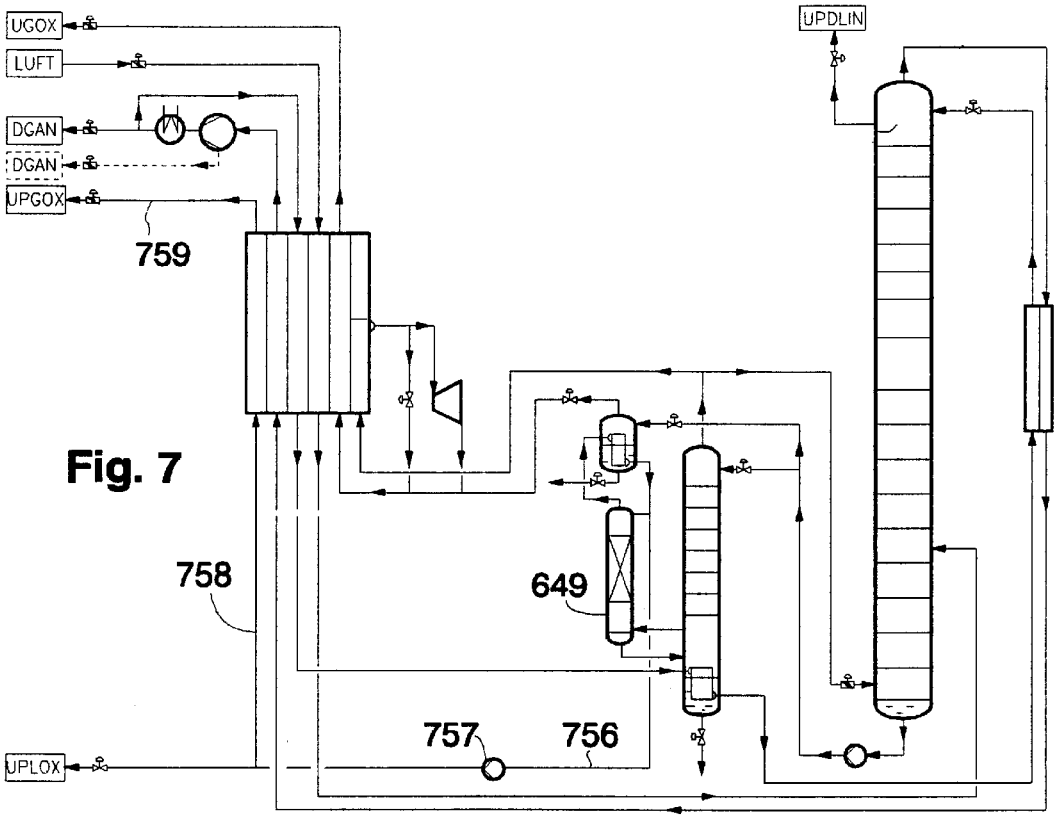
FIG. 7 shows a variant of the process of FIG. 6 with internal compression of highly pure oxygen.

FIG. 7 shows how the gaseous highly pure oxygen can be disposed of by means of internal compression under a pressure that is higher than the operating pressure of additional column 649 and is, for example, about 8 bar. Here, the entire highly pure product is drawn off in liquid form via line 756 and brought to increased pressure in a pump 757. At least one portion 758 is evaporated under this pressure in main heat exchanger 2 and drained off at 759 as highly pure compressed oxygen product.

Figure 8:
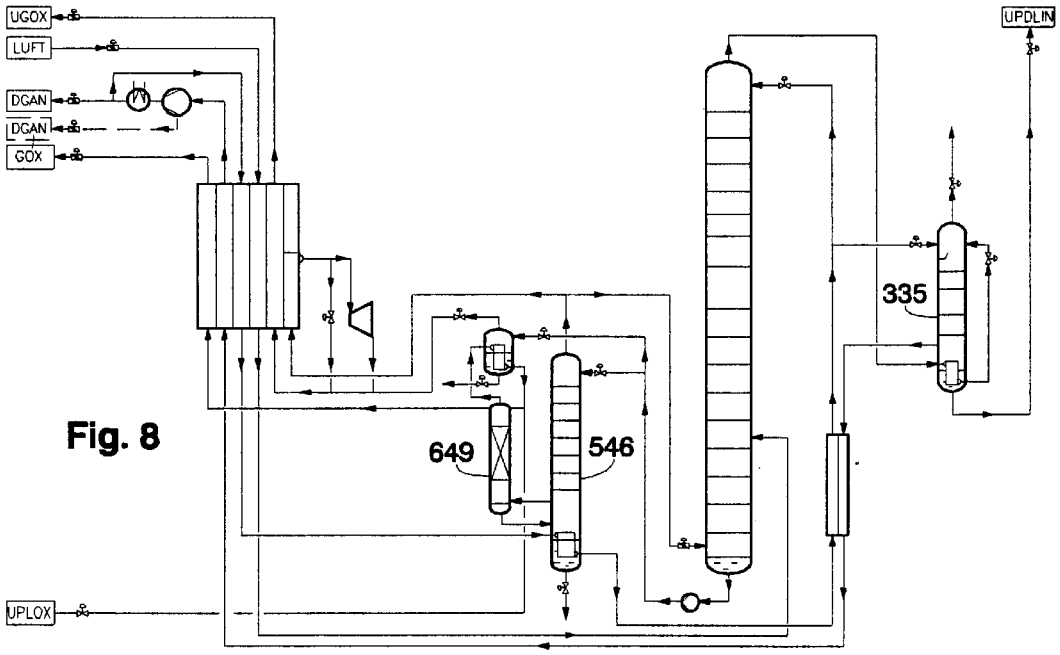
FIG. 8 shows a process in which simultaneously highly pure nitrogen and highly pure oxygen are obtained.
Figure 9:
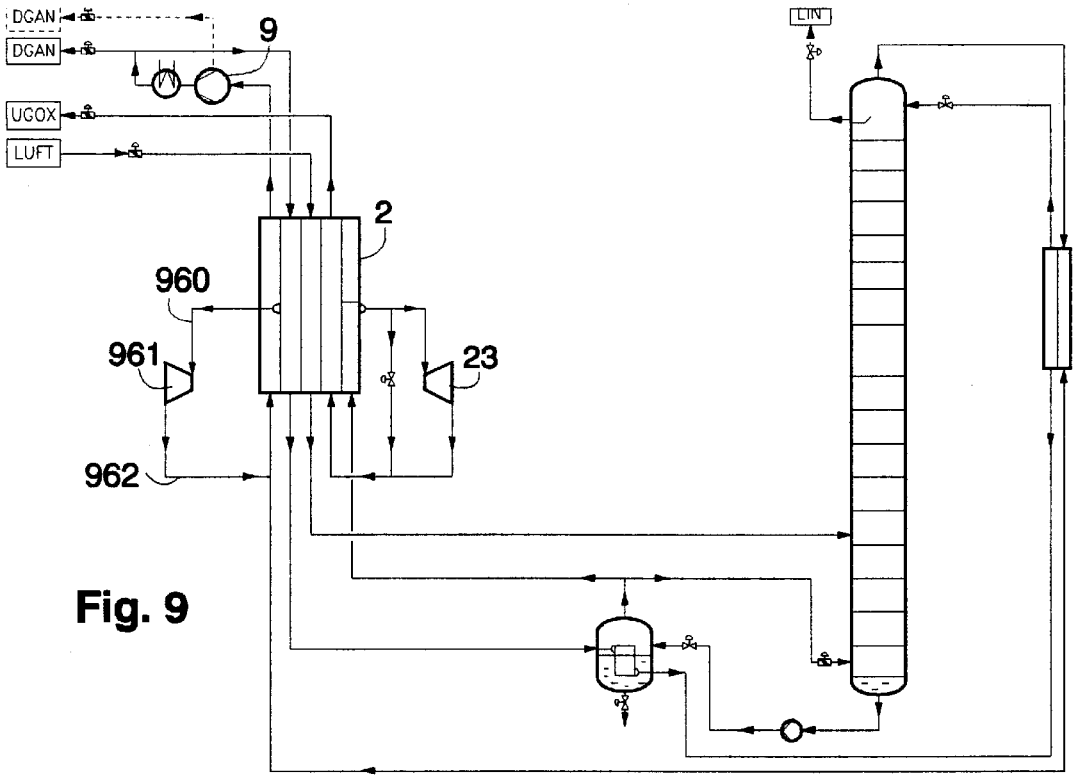
FIG. 9 shows a variant of the process of FIG. 2 with a second turbine.

In FIG. 8, pure nitrogen column 335 from FIG. 3 and two columns 546 and 649 of FIG. 6 are implemented together so that nitrogen and oxygen can be obtained simultaneously as ultra pure products UPDGAN and UPGOX.

For the production of further increased liquid amounts, all previously described embodiments can be supplemented by a second turbine 961, in which a portion 960 of the circulation nitrogen compressed in the circulation compressor is machine expanded. This is depicted by way of example in FIG. 9, which otherwise corresponds to FIG. 2. This portion is drained off from the main heat exchanger at an intermediate temperature, which is equal to the starting temperature of first turbine 23 or is higher or lower. Depressurized nitrogen 962 is fed back into the circuit.

Figure 10:
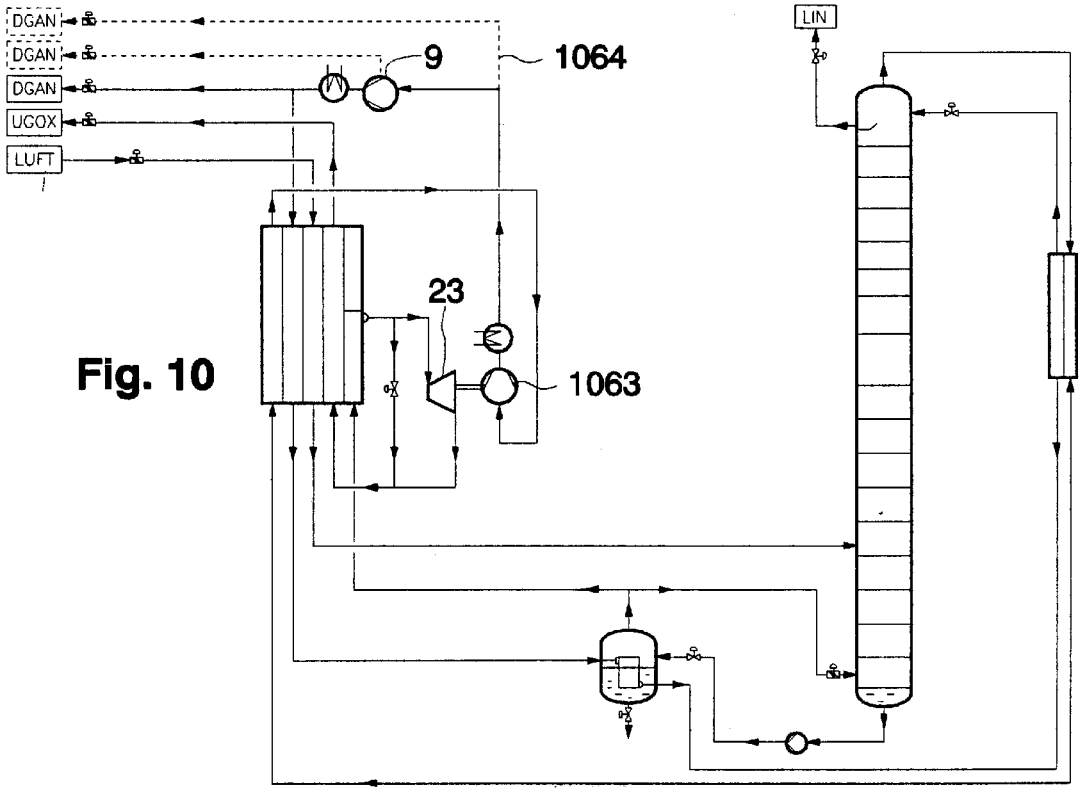
FIG. 10 shows another variant of the process, depicted in FIG. 2, with a turbine booster.

Whereas in the previous embodiments, residual-gas turbine 23 is coupled to a generator or to another braking device to drain off mechanical energy, in FIG. 10 it is driven directly into a booster 1063, which is placed upstream from the externally driven circulation compressor and in the latter draws off a portion of the compression work without consuming energy that is introduced from outside. FIG. 10 is otherwise identical to FIG. 2. Depending on the size of the unit, it can be useful in any of the described variant embodiments to use such a turbine booster. In addition, in FIG. 10, the optional removal of a nitrogen product 1064 under the exhaust pressure of booster 1063 is shown.

Figure 11:
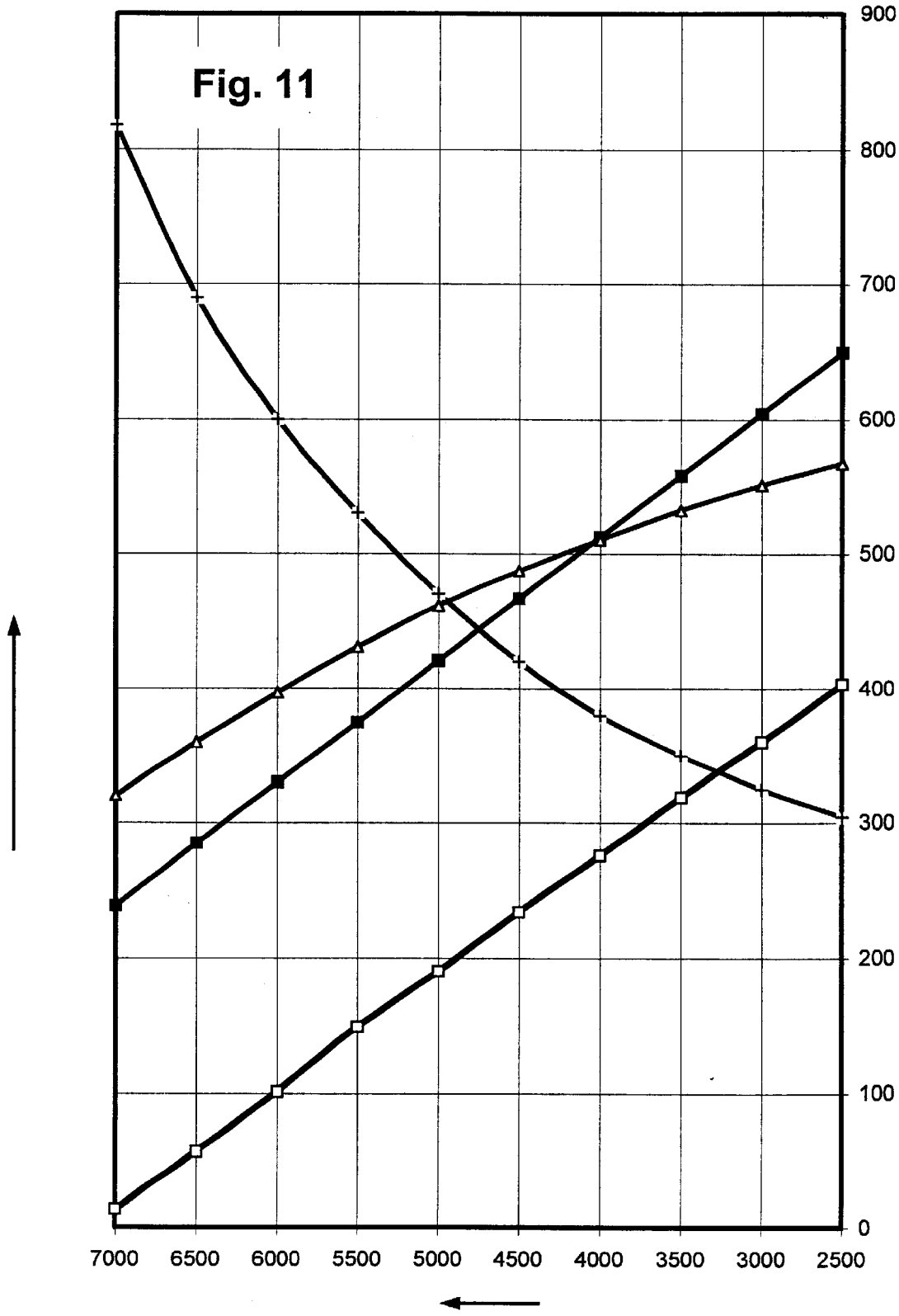
FIG. 11 shows a diagram that relates to the operation of the embodiment of FIG. 2.

An essential aspect of the invention provides a flexible operating method of the unit with respect to the proportion of liquid product. The graph of FIG. 11 is used to illustrate these possibilities of operating the process of FIG. 2 with different or varying product specifications, specifically—in the example depicted here—at constant operation of the air compressor (9,400 $Nm^3/h$ at 3.4 bar of exhaust pressure) and circulation compressor 9 (15,200 $Nm^3/h$ at 9.5 bar of exhaust pressure).

In this case, the amount of gaseous nitrogen product in $Nm^3/h$, which is drawn off via line 19 (line 20 that is drawn in dotted lines in FIG. 2 is not used in the example), is plotted to the left. According to the above, the following parameters are plotted:

+ Oxygen concentration in the evaporation chamber of condenser-evaporator 214 in [mol %·10]

Δ Pressure in the evaporation chamber of the condenser in [bar·100]

V Mass flux by turbine 23 in [$Nm^3/h/10$]

□ Amount of LIN-product via line 18 in [$Nm^3/h$].

The graph shows the increase of the amount of liquid product (under curve) of slightly above zero (left) to 400 $Nm^3/h$. In this case, the pressures in the condenser-evaporator and the turbine flow rise, while the oxygen concentration in the condenser and the amount of gaseous product nitrogen drop. The operating pressure of the column within the column remains constant in this case.

The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever.

The entire disclosure of all applications, patents and publications, cited above and below, and of corresponding German application DE 10013075.5, filed Mar. 17, 2000, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for obtaining gaseous and liquid nitrogen with a variable proportion of the liquid product by low-temperature separation of air in a distillation column system having a single column, said process comprising:

cooling compressed feed air in a main heat exchanger and introducing the resultant cooled feed air to said single column operating under pressure;

withdrawing a nitrogen-rich fraction from the distillation column system and compressing said nitrogen-rich fraction, at least in a part in a circulation compressor;

passing a part of said nitrogen-rich fraction downstream from said circulation compressor to a liquefaction chamber of a condenser-evaporator and condensing said first part of said nitrogen-rich fraction under a pressure higher than the operating pressure of said single column so as to form a nitrogen-rich liquid;

passing a liquid, oxygen-enriched fraction from the distillation column system to an evaporation chamber of the condenser-evaporator so as to at least partially evaporate said liquid, oxygen-enriched fraction;

passing a first oxygen-enriched gas (234, 533) formed in the evaporation chamber, as ascending vapor into the single column; and withdrawing a second portion of nitrogen-rich fraction at least at times as gaseous nitrogen product, characterized in that a part of said nitrogen-rich liquid is withdrawn from the condenser-evaporator at least at times as liquid product, the evaporation chamber of condenser-evaporator is operated at least at times under a pressure higher than the operating pressure of the single column, and a second oxygen-enriched gas is withdrawn from at least one of (1) a column in the distillation system and (2) the evaporation chamber of the condenser-evaporator, and the resultant withdrawn second oxygen enriched gas is machine expanded and then heated in the main heat exchanger.

2. A process according to claim 1, wherein an oxygen-enriched liquid is withdrawn from the single column (4) and increased in pressure in the liquid state and wherein a second oxygen-enriched gas (232, 221, 521) is produced from the resulting oxygen-enriched liquid (231) under increased pressure.

3. A process according to claim 2, wherein the oxygen-enriched liquid downstream of the pressure increase is introduced, as the oxygen-enriched liquid fraction into the evaporation chamber of the condenser-evaporator.

4. A process according to claim 2, wherein the distillation column system comprises a pure oxygen column, and passing the oxygen-enriched liquid downstream from the pressure increase into the pure oxygen column (546), and an oxygen-rich fraction (547) is drawn off from the a lower part of the pure oxygen column (546), wherein the liquid oxygen-enriched fraction, fed to the evaporation chamber of condenser-evaporator (514), is derived from the lower part of pure oxygen column (546) and wherein gas produced in the condenser-evaporator is introduced as ascending vapor, into the lower part of the pure oxygen column.

5. A process according to claim 4, wherein the distillation column system comprises an additional column for the removal of low-volatility contaminants, and an oxygen-rich fraction (650) from the pure oxygen column is introduced into said additional column, and a pure oxygen product is withdrawn from an upper part of the additional column (649).

6. A process according to claim 5, wherein said additional column comprises a top condenser in which a second oxygen-enriched liquid fraction (652) from the lower part of the single column is at least partially evaporated.

7. A process according to claim 4 wherein the entire reflux liquid for single column (4) and pure oxygen column (546) is produced in said condenser/evaporator.

8. A process according to claim 1, wherein the entire reflux liquid required for the single column (4) is produced in condenser-evaporator (14, 514).

9. A process according to claim 1, wherein at least a portion of the mechanical energy produced by work expansion of the second oxygen-enriched gas is used for compressing at least one nitrogen-rich fraction.

10. A process according to claim 1, wherein the distillation column system comprises a pure nitrogen column, a nitrogen fraction is passed from the upper part of the single column in a liquid state into a top part of the pure nitrogen column, and a pure nitrogen product is withdrawn from the lower part of the pure nitrogen column.

11. A process according to claim 10, wherein the pure nitrogen column comprises a bottom evaporator, and a nitrogen fraction is withdrawn in gaseous form from the single column and is liquefied in the bottom evaporator and the liquefied nitrogen fraction is passed into the top part of the pure nitrogen column.

12. An apparatus for obtaining gaseous nitrogen by low-temperature separation from air with a distillation column system comprising a single column (4), an air compressor, a main-heat exchanger, passage means for feed air to the single column (4) from the air compressor through the main heat exchanger (2);

a circulation compressor (9, 1063) for compression of the first portion of a nitrogen-rich fraction (5, 7, 8) from the distillation column system;

a circulation line (12, 13), from the outlet of circulation compressor (1063, 9) to a liquefaction chamber of a condenser-evaporator (14);

means for feeding a liquid, oxygen-enriched fraction from the distillation column system to the evaporation chamber of condenser-evaporator (14);

means for the production of a first oxygen-enriched gas (234, 533) from vapor (232) formed in the evaporation chamber of the condenser-evaporator (14) and for introduction into the single column (4), and a gas production line for drawing off a second portion (19,

20, 1064) of nitrogen-rich fraction (5, 7, 8) as a gaseous nitrogen product, said apparatus further comprising a liquid product line (16, 16), connected to the liquefaction chamber of the condenser-evaporator (14), said condenser-evaporator (14) being inside a container separated from single column (4), and a machine (23) for expanding a second oxygen-enriched gas (221, 521) from one of columns (546) of the distillation system or from the evaporation chamber of condenser-evaporator (14), or from both of the columns (546) and the evaporation chamber of condenser-evaporator (14), and means for passing resultant expanded second oxygen-enriched gas to said main heat exchanger.

13. A process according to claim 12, wherein air compressors and the circulation compressor (9) are formed by a single machine.

* * * * *